US005127241A

United States Patent [19]

Plath

[11] Patent Number: 5,127,241

[45] Date of Patent: Jul. 7, 1992

[54] YARN FEED ARRANGEMENT WITH AT LEAST ONE YARN GUIDE FOR A CIRCULAR KNITTING MACHINE

[75] Inventor: Ernst-Dieter Plath, Albstadt, Fed. Rep. of Germany

[73] Assignee: Sipra Patententwicklungs- und Beteiligungsgesellschaft mbH, Albstadt, Fed. Rep. of Germany

[21] Appl. No.: 541,159

[22] Filed: Jun. 20, 1990

[30] Foreign Application Priority Data

Jun. 22, 1989 [DE] Fed. Rep. of Germany ..... 3920408

[51] Int. Cl.[5] ..... D04B 15/58

[52] U.S. Cl. ..... 66/141; 66/125 R

[58] Field of Search ..... 66/125 R, 141, 142, 66/143

[56] References Cited

U.S. PATENT DOCUMENTS

| | | | |
|---|---|---|---|
| 622,542 | 4/1899 | Ruth | 66/143 |
| 1,116,190 | 11/1914 | Williams | 66/141 X |
| 3,672,186 | 6/1972 | Rab | 66/141 X |
| 4,441,339 | 4/1984 | Yorisue | 66/141 X |
| 4,688,401 | 8/1987 | Kuhn et al. | 66/141 |
| 4,916,925 | 4/1990 | Pernick | 66/141 |

FOREIGN PATENT DOCUMENTS

| | | | |
|---|---|---|---|
| 602632 | 4/1978 | U.S.S.R. | 66/141 |
| 2146358 | 4/1985 | United Kingdom | 66/141 |

*Primary Examiner*—Werner H. Schroeder
*Assistant Examiner*—John J. Calvert
*Attorney, Agent, or Firm*—Michael J. Striker

[57] ABSTRACT

The invention relates to a yarn feed arrangement with at least one yarn guide (12) for a circular knitting machine comprising a needle cylinder (1), knitting implements (3) which are mounted movably therein and which have hooks (5) for receiving a yarn (4) fed thereto by the yarn guide, and a cam (7) which acts on the knitting implements in such a way that the hooks are guided on a track which has an extension section, a retraction section and a maximum disposed therebetween. The yarn guide has a through opening (14) for guiding the yarn and a guide surface (28) which is intended for guiding the yarn and which is disposed on its front side (21). In that arrangement the guide surface (28) is provided on an extension portion (26) which is disposed at the underside of the yarn guide (12) (FIG. 1).

22 Claims, 7 Drawing Sheets

Fig. 2.
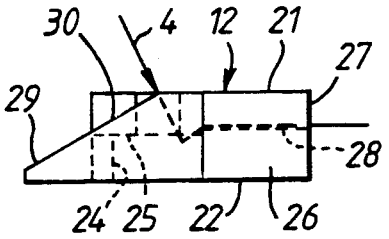
Fig. 3.
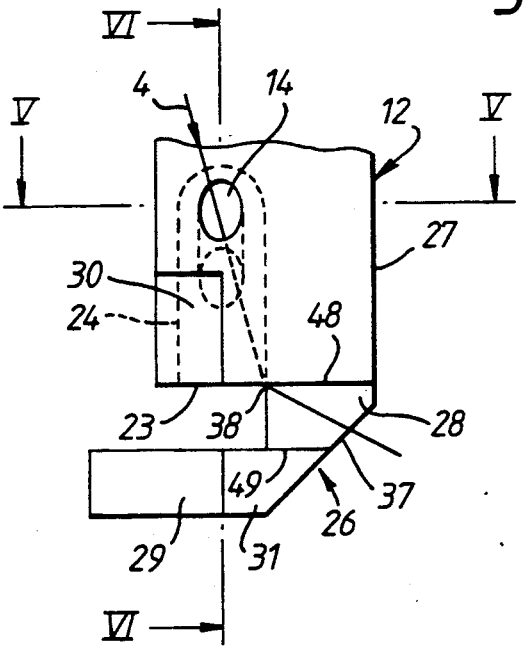
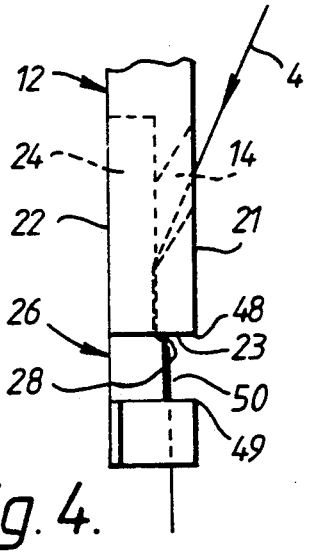
Fig. 4.
Fig. 5.
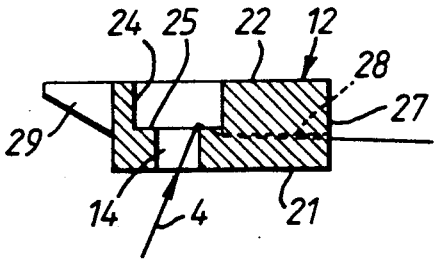
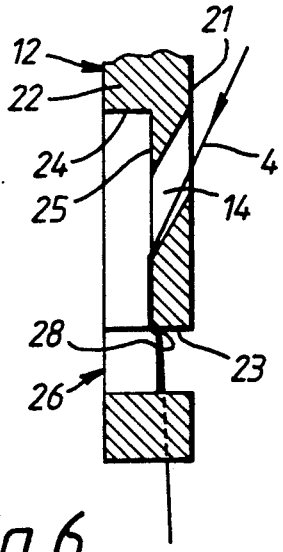
Fig. 6.

YARN FEED ARRANGEMENT WITH AT LEAST ONE YARN GUIDE FOR A CIRCULAR KNITTING MACHINE

BACKGROUND OF THE INVENTION

The invention relates to a yarn feed arrangement for a knitting machine.

In a known yarn feed arrangement of that kind (German laid-open application (DE-OS) No. 36 16 658) the yarn must be threaded from the back forwardly into the through opening of the yarn guide. That is a tedious operation which can scarcely be carried out because of the constricted conditions in respect of space, in particular in the case of high output machines with for example 72 knitting systems. Apart from that, there is only a narrow guide surface immediately adjoining the eye available for guiding and stabilising the yarn prior to its being passed into the hooks of the knitting implements.

Another known yarn feed arrangement of the general kind set forth in the opening part of this specification (German laid-open application (DE-OS) No. 15 85 437) is of a similar design configuration. For the purposes of feeding the yarn, that apparatus also has a respective yarn change device so that the conditions in regard to threading in the yarns, reliably feeding the yarns and conditions in respect of space are even worse.

Finally, a yarn feed arrangement of the kind set forth in the opening part of this specification is known (German laid-open applications (DE-OS) Nos. 33 24 245 and 34 21 868) wherein the through opening of the yarn guide comprises an open eye into which the yarn can also be easily threaded from the front and in which the guide surface is formed by a yarn guide groove provided in a cylindrical body. Although in that way the above-mentioned problems in relation to knitting procedure can be substantially avoided, that is only at the expense of an overall assembly which is comparatively complex from the structural point of view and which would represent a considerable cost factor in relation to high output machines with a large number of knitting systems.

SUMMARY OF THE INVENTION

The invention is based on the problem of improving the yarn feed arrangement of the kind set forth in the opening part of this specification, in such a way that it permits the yarns to be threaded in from the front or also from the side, it can be provided with a guide surface which satisfies the requirements made in respect thereof, while nonetheless having a yarn guide which is comparatively simple to produce and thus inexpensive.

In accordance with the present invention a yarn feed arrangement which has at least one yarn guide for a circular knitting machine comprising a needle cylinder, knitting implements which are movably mounted in the needle cylinder and which have hooks for receiving a yarn fed thereto by the yarn guide, and a cam acting on the knitting implements in such a way that the hooks are guided on a track which has a raising section, a retraction section and a maximum disposed therebetween, wherein the yarn guide has a front side, a rear side, an underside, a side associated with the raising section of the track, a through opening leading from the front side to the rear side, an extension portion at its underside and a guide surface being provided on a front side of the extension portion, the guide surface being intended to guide the yarn when leaving the yarn guide for feeding the yarn to the hooks from a location outside the track and before and lateral of the maximum in such a way that it is engaged by the hooks which are guided along the retraction section, and the arrangement being such that the yarn passes the through opening from the front side to the rear side and is then diverted at the underside and by the extension portion onto the guide surface.

By virtue of the guide surface being provided on a lower extension portion on the yarn guide, the yarn can be introduced into the through opening from the front. In addition the guide surface formed on the extension portion can be designed freely without that meaning that the other parts of the yarn guide have to be substantially altered from a structural point of view so that the yarn guide is overall a component which can be produced inexpensively.

BRIEF DESCRIPTION OF THE DRAWINGS

The invention is described in greater detail hereinafter by means of embodiments with reference to the accompanying drawings in which:

FIGS. 2 to 6 are respectively a bottom view, a front view, a side view and views in section taken along lines V—V and VI—VI in FIG. 3, on an enlarged scale, of a yarn guide of the yarn feed arrangement according to the invention.

DESCRIPTION OF PREFERRED EMBODIMENTS

Figure 1:
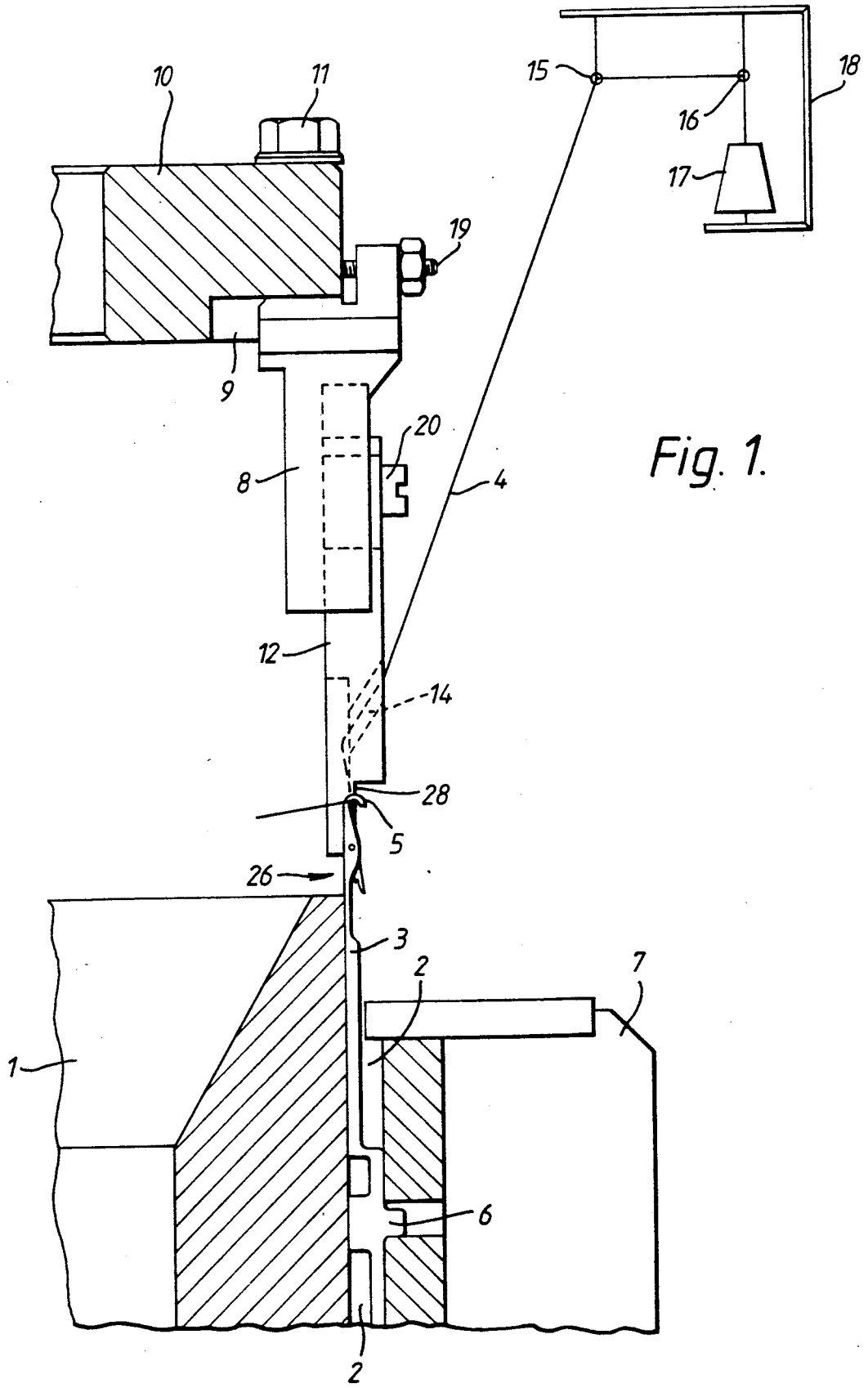
FIG. 1 is a diagrammatic view in longitudinal section through a circular knitting machine with a yarn feed arrangement according to the invention.

The circular knitting machine which is only diagrammatically illustrated in FIG. 1 comprises a needle cylinder 1 with bar portions 2 and slots disposed between them, in which knitting implements 3 with hooks 5 for receiving a yarn 4 are mounted in such a way that they can move up and down. The associated sinkers or the like are not shown. The knitting implements 3 have butts 6 with which there is associated a cam 7 by means of which the knitting implements 3 are extended and retracted in known manner on each knitting system in order to receive the yarn 4 and to produce stitches. A holder 8 is fitted into a recess 9 in a frame portion 10 of the circular knitting machine and secured thereto by means of a screw 11. Secured to the holder 10 is a yarn guide 12. The yarn guide 12 has a through opening 14 for the yarn 4 which is fed thereto by way of eyes 15 and 16 from a supply bobbin 17 which, like the eyes 15 and 16, is disposed on a further frame portion 18 of the circular knitting machine. The yarn guide 12 can be adjusted radially relative to the needles 3 by means of an adjusting screw 19 which is screwed into the holder 8 and which bears against the frame portion 10 and onto which a lock nut is screwed. For fixing thereof to the holder 8, the arrangement has a clamping screw 20 which passes through a slot in the yarn guide 12 so that the yarn guide 12 is also adjustable in respect of height, that is to say parallel to the needle movement.

The circular knitting machine may be a machine with a rotatable needle cylinder 1 and a stationary cam 7 and stationary frame portions 10 and 18, or a machine in which the cam 7 and the frame portions 10 and 18 are rotated about a stationary needle cylinder.

Circular knitting machines of the above-described kind and the functions thereof are generally known and therefore do not need to be described in greater detail.

The design configuration of the yarn guide 12 in accordance with the invention is shown in particular in FIGS. 2 to 6. The yarn guide 12 includes a plate-like, substantially parallelepipedic body which in particular has a front side 21, a rear side 22, an underside 23 and the through opening 14 which extends from the front inclinedly downwardly and rearwardly, as shown in particular in FIGS. 4 and 6. Provided in the rear side 22 of the yarn guide 12 is a groove 24 which extends from the underside 23 in the direction of the topside which is not shown in FIGS. 2 to 6, and can end above the through opening 14. The groove 24 has a preferably flat bottom 25 at which the through opening 14 opens into the groove 24.

At its underside 23 the yarn guide 12 additionally has an attachment or extension portion 26 which is extended downwardly beyond the parallel epipedic body and whose rear side may lie for example in the same plane as the rear side 22. A preferably flat part, which adjoins one side 27 of the yarn guide 12, of the front side of the extension portion 26 is in the form of a guide surface 28 for the yarn 4 and, as can be seen in particular from FIGS. 2, 4, 5 and 6, is preferably displaced rearwardly, in comparison with the front side 21, in such a way that its spacing from the front side 21 is less than the spacing of the bottom 25 of the groove 24 from the front side 21. Alternatively the guide surface 28 is arranged displaced forwardly relative to the rear side 22 of the exit end of the through opening 14. Another part of the front side of the extension portion 26 is in the form of an inclined safety surface 29 which extends inclinedly from the rear forwardly and lies beneath and—as considered in the direction of needle movement—in front of the guide surface 28. A corresponding inclined surface 30 (see FIGS. 2 and 5) which extends substantially from the rear side 22 to the front side 21 is provided directly on the parallelepipedic body on the side of the yarn guide 12 which is in opposite relationship to the side 27.

FIGS. 2 to 6 each also show the path of the yarn 4 in passing through the yarn guide 12, and its direction of movement as indicated by an arrow. In accordance therewith the yarn 4 coming from the bobbin 17 (FIG. 1) passes from the front into the through opening 14. The yarn 4 is then deflected and guided downwardly along the bottom 25 of the groove 24. Thereafter the yarn 4 is diverted along the underside 23 of the yarn guide 12 in a forward direction and then along a deflection edge 38 towards the side. Finally the yarn 4 leaves the yarn guide 12 in a lateral direction, being guided inclinedly along the guide surface 28. Therefore, in the event of a yarn breakage or the like, it is easily possible for the yarn 4 to be threaded into the through opening 14 from the front until, due to the force of gravity acting thereon, it drops down on the rear side 22 of the yarn guide 12 and can then be gripped from beneath the underside 23, possibly joined to the other end of the yarn and then positioned on the guide surface 28. If necessary, for the purposes of gripping the end of the freshly threaded yarn, it is also possible to use the wire hook which is usually carried by the operator of a circular knitting machine, by that hook being pushed through between the yarn guide 12 and the knitting implements 3 (FIG. 1).

Figures 7, 8:
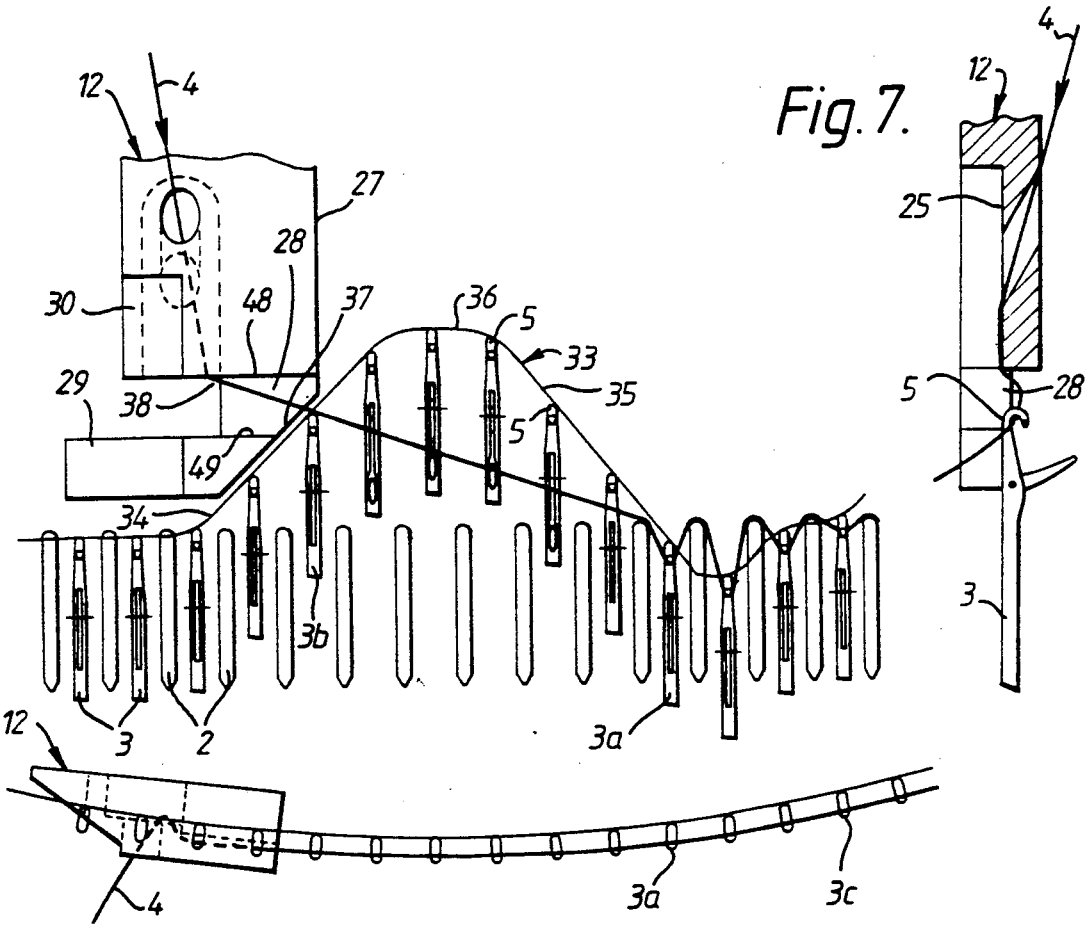
FIG. 7 is a diagrammatic front view of a knitting system using the yarn guide shown in FIGS. 2 to 6.
FIG. 8 is a diagrammatic plan view of the part of the circle of needles shown in FIG. 7, FIGS. 9 and 10, and FIGS. 11 and 12, are views corresponding to FIGS. 7 and 8 respectively of a further embodiment of the yarn feed arrangement according to the invention.

FIGS. 7 and 8 show use of the yarn guide 12 according to the invention in connection with a circular knitting machine in which the knitting implements are conventional latch needles. In that connection FIG. 7 only shows one knitting system with a yarn guide 12. The other knitting systems can be of a corresponding configuration. In the region of each system the knitting implements 3 are extended and retracted by the associated cam 7 (FIG. 1) in such a way that their hooks 5 pass through a track 33 which has a rising extension section 34, a retraction section 35 following same, and a maximum 36 disposed therebetween. Each yarn guide 12 lies with its side 27 directly at the extension section 34 of that track 33 along which the knitting implements 3 receive the yarn supplied by same. In order in that case to be able to arrange the guide surface 28 as closely as possible to the extension section 34, the latter, towards the side 27, has an inclined surface 37 which can be seen in particular in FIG. 3 and which, when the yarn guide 12 is correctly set, is arranged parallel to and directly beside the associated extension section 34. In other respects the relative position of the yarn guide 12 with respect to the associated track 34 is established substantially in known manner in order to provide for secure introduction of the yarn 4 into the knitting implements 3 and if necessary also in addition or as an auxiliary matter to provide for opening of needle latches which are still closed, by the yarn 4 (German laid-open applications (DE-OS) Nos. 15 85 437 and 33 24 245) if the needle latches are not automatically opened by the loops in the hooks 5. The guide surface 28 can be arranged between the projection of the through opening 14 onto the underside 23 and the side 27 associated with the extension section 34.

In order to permit the yarn 4 to be reliably introduced, the guide surface 28 is preferably arranged substantially in that plane in which the front sides of the hooks 5 of the knitting implements 3 also move, as can be seen in particular from the side view shown at the right in FIG. 7. In that way, when the knitting implements 3 rise along the extension section 34 the yarn 4 securely slides onto the front side and not for example onto the rear side of the knitting implements 3, on the one hand, and on the other hand slides securely into the hooks 5 when the knitting implements 3 are lowered again along the retraction section 35 in order to receive the yarn 4 at the end thereof. In that situation a beneficial effect is produced by the fact that the knitting implements 3 are arranged along the periphery of the needle cylinder 1 on a circular arc which, as shown in FIG. 8, means that the yarn 4 is progressively moved towards the knitting implement for receiving it, as identified by reference 3*a*.

The inclined surface 29 and also the inclined surface 30 do not serve to feed the yarn, but serve for the purpose of preventing collision with the yarn guide 12 of those knitting implements which, as a result of breakage of a butt 6 (FIG. 1) or the like, pass into a knitting system in a raised position. Those knitting implements 3 are pivoted radially outwardly by the inclined surface 30 or the inclined safety surface 29 and are thus guided past the yarn guide 12 without damaging it.

A particular advantage of the yarn guide 12 according to the invention is that its guide surface 28 can be freely designed independently of the other parts and can be appropriately suited to the requirements involved. As the yarn 4 is only engaged by the knitting implement 3*a* shown in FIGS. 7 and 8 and is guided from the yarn guide exit as far as same freely or floatingly, known yarn feed arrangements of that kind frequently involve the risk that the free yarn portion may oscillate in operation of the circular knitting machine and thereby, as it goes past the first knitting implement which passes the yarn, as indicated at 3*b* in FIG. 7, may go to the rear side thereof and can then no longer be engaged by the hook 5. In comparison therewith the yarn 4 when using the yarn guide 12 according to the invention is sufficiently pretensioned by the changes in direction in the region of the through opening 14, the underside 23 and the extension portion 26, on the one hand, while on the other hand it is guided along the guide surface 28 over a comparatively wide portion. As a result the guide surface 28 acts at the same time as a stabilisation zone for the yarn 4 and thereby permits it to be safely introduced. In that connection it is also advantageous that the guide surface 28 may be of a comparatively great width, which has an advantageous effect on the running of the yarn.

The configuration of the yarn guide 12 according to the invention also promotes safe introduction of the yarn 4 in situations in which the yarn is not made into a loop by the knitting implement 3*a* but is last made into a loop by a knitting implement which is further away (for example as indicated at 3*c* in FIG. 8), as happens when a plurality of successive knitting implements 3 in a system are not selected to receive yarn. That is the case in particular when the guide surface 28 is arranged with its inclined surface 37 immediately beside that knitting implement 3*b* which passes the yarn 4 in the extension mode. Finally there is the advantage that upward movement of the yarn 4 with the knitting implement 3 is substantially impossible because that is prevented by the underside 23 or the extension portion 26. In that way it is possible for the through opening 14 to be of a relatively large cross-section, which is advantageous in regard to threading in the yarn 4, passing any knots and keeping the arrangement clean.

FIGS. 9 to 12 show an embodiment in which the yarn guide 12 according to the invention which was described above with reference to FIGS. 1 to 8 and in relation to which the same components are identified by the same reference characters is combined with a normal yarn guide 41. The term normal yarn guide 41 is used to identify a yarn guide which is not arranged laterally beside the track 33 of the hooks 5 but immediately in front of same, as is the case with the conventional yarn guides which are predominantly employed. Like the lateral yarn guide 12 shown in FIG. 1, the normal yarn guide 41 is clamped fast to the frame portion 10 by means of a screw and is arranged thereon displaceably in parallel relationship to the movement of the knitting implements 3. In that situation it is possible for the normal yarn guide 41 to be arranged in the inoperative position shown in FIGS. 9 and 10 in which it performs no function, or to be moved into the operative position shown in FIGS. 11 and 12 in which it can have a number of functions.

Figure 11:
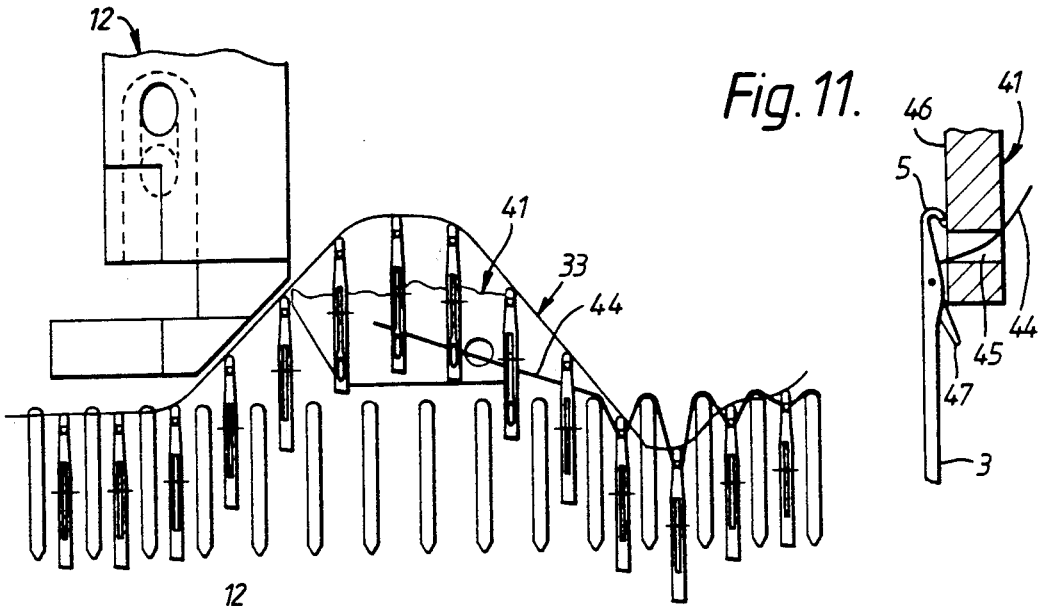
Figure 12:
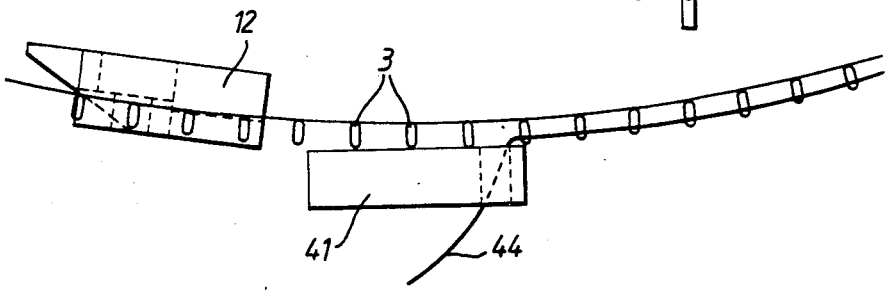

One of those functions is to be found in FIGS. 11 and 12, namely feeding a yarn 44 with an inactive yarn guide 12. In that situation, shown at the right in section in FIG. 11 is the way in which the yarn 44 is passed into the hooks 5 of the knitting implements, more specifically by means of a conventional eye 45 arranged immediately in front of the receiving region of the open hook 5. In that situation a rear side 46 of the normal yarn guide 41 serves at the same time to hold open any latches 47 of the knitting implement 3. That function is absolutely necessary for example in relation to particular forms of stitch configurations, for example the fancy knitting mode in conjunction with a filling yarn, because there is no latch impact in respect of the closing latches 47 and the yarn 44 must be very accurately introduced into the hooks 4. The yarn guide 12 is less suited to that purpose. Alternatively the normal yarn guide 41 could also be used together with the yarn guide 12 in order for two yarns to be introduced into the hooks 5 on one system.

Another function of the normal yarn guide 41 may finally involve it acting as a cover means. If with the lateral yarn guide 12 for example a yarn with loose filaments, in particular an untwisted polyester yarn, is fed to the system, then individual filaments can jump out of the hooks 5, in particular when a loose piece of knitting is to be produced and the yarn 4 flutters in spite of the presence of the guide surface 28. In that case the normal yarn guide 41 is also moved into the operative position shown in FIGS. 11 and 12, although it is not feeding any yarn. In that case however, as shown in FIG. 11 (on the right) it is arranged so closely in front of the knitting implements 3 that loose filaments are reliably prevented from jumping out of the hooks 5.

Figure 9:
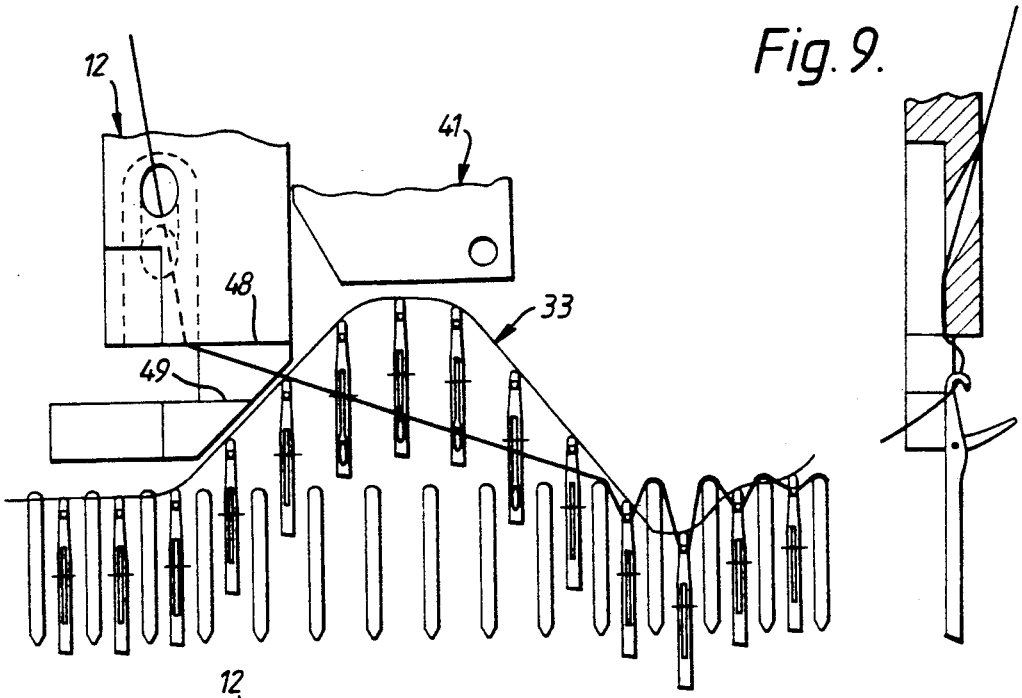
Figure 10:
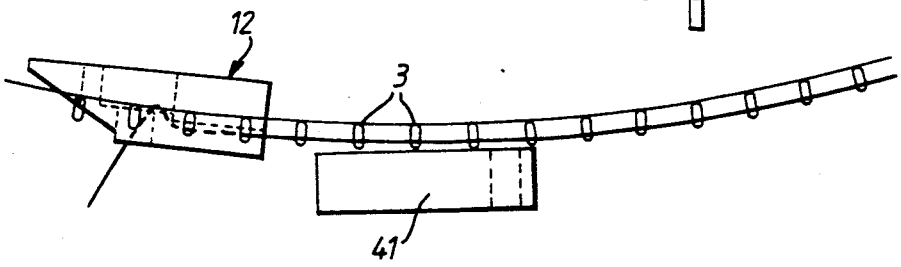

When using different knitting implements from the latch needles shown in FIGS. 9 and 11, in particular when using slider or compound needles, the yarn guide 12 according to the invention is particularly important as in those cases the normal yarn guide 41 is practically useless for reliably feeding the yarn.

Instead of the normal yarn guide 41, for the purposes of covering over the hooks 5, it will be appreciated that it is also possible to use a cover element in which there is no eye 45 but which in other respects may be of substantially the same design configuration. That cover element may alternatively be secured to the yarn guide 12, preferably adjustably, so that it can be adjusted in respect of height and perpendicularly to that plane in which the front ends of the hooks move. It will be appreciated that it would also be possible in that respect for the cover element to be in the form of a lateral projection portion on the yarn guide 12 and to be made in one piece therewith.

Figure 13:
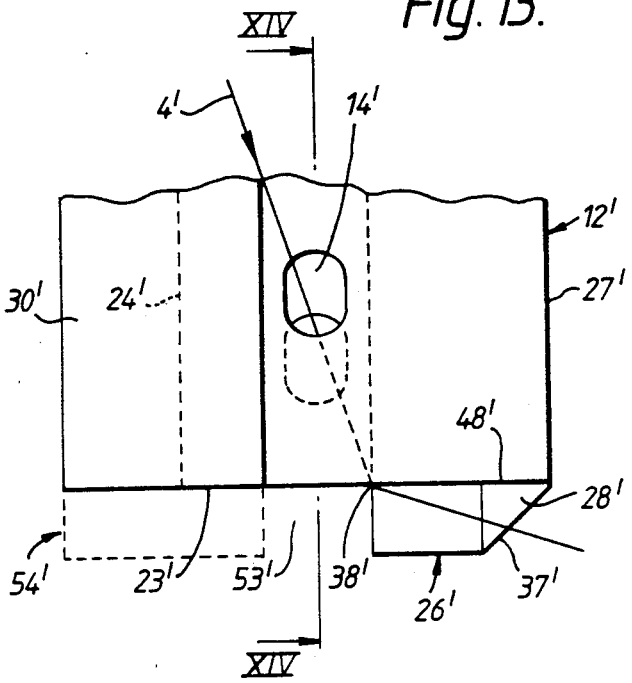
FIGS. 13 to 15 are a front view, a view in section taken along line XIV—XIV in FIG. 13 and a bottom view respectively of a second embodiment of a yarn guide according to the invention, and FIGS. 16 and 17, and FIGS. 18 and 19 respectively, show third and fourth embodiments of the yarn guide according to the invention as a bottom view and a front view.
Figure 14:
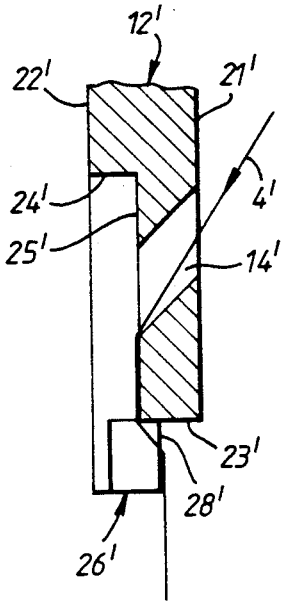
Figure 15:
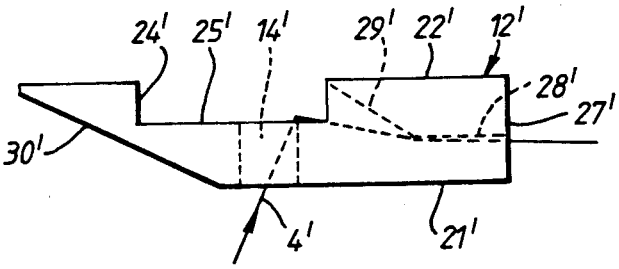

In the embodiment of a yarn guide 12 according to the invention as shown in FIGS. 13 to 15, corresponding components are identified by the same reference characters but with the addition of a prime in comparison with FIGS. 2 to 6. In the case of the yarn guide 12' the inclined safety surface 29' is not provided beneath the guide surface 28' but on a part of the extension portion 26' which is between the guide surface 28' and the closer side wall of the groove 24' or the direction-changing edge 38'. The inclined safety surface 29' is desirably of such a configuration that it is not touched by the yarn 4'. In that connection the guide surface 28' may be at a comparatively large spacing from the direction-changing edge 38', which has an advantageous effect on the running of the yarn. In addition the inclined surface 30' of the yarn guide 12' extends over its entire height. Finally, as a comparison of FIGS. 4 and 14 shows, the front side 21 of the yarn guide body in the yarn guide 12 is disposed substantially in the same plane as the front side of a part 31 of the extension portion 26, which adjoins the end of the inclined safety surface 29, while in the case of the yarn guide 12' the inclined safety surface 29' goes into the guide surface 28' which is displaced rearwardly relative to the front side 21'. In other respects the yarn guide 12' involves the same advantages, function and various use options as the yarn guide 12.

In addition it is possible and advantageous for the guide surface 28, 28' to be delineated upwardly or downwardly respectively by a respective projecting edge or the like in order to prevent the yarn 4, 4' from sliding off upwardly upon extension of the knitting implements 3 or downwardly in the event of excessively low yarn tension. An upper edge 48, 48' of that kind (see FIGS. 3 and 13 respectively) automatically occurs by virtue of the described construction of the yarn guide 12, 12' while a corresponding lower edge 49 (see FIG. 3) is readily present only in the case of the yarn guide 12. As a result, in the case of the yarn guide 12, between the two edges 48 and 49 which can also be seen in FIGS. 7 and 9 there is a guide passage 50 for the yarn 4, which is open towards the front side and which stabilises the yarn 4 upon extension of the knitting implements 3 or in a situation involving excessively low yarn tension. In that connection the upper edge 48 should be disposed beneath the hooks 5 of the knitting implements 3 which are extended to the maximum extent (maximum 36 in FIG. 7) whereas the lower edge 49 should be above the free ends of the open latches 47 of the knitting implements 3 which are extended to the maximum extent, so that the yarn 4, 4' cannot slide off under the latches 47. In addition the edges 48, 48' or 49 and the direction-changing edges 38, 38' should be so arranged and so oriented relative to the knitting implements 3 and the track 33 that the yarn 4, 4', as shown in FIGS. 7 and 9, forms a chord between the extended and retracted knitting implements 3, and in that situation passes in each case between the opened hooks 5 and the free ends of the latches 47.

Figure 16:
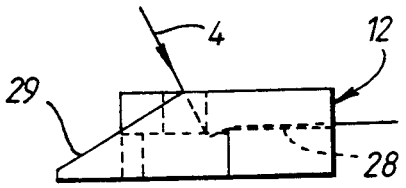
Figure 17:
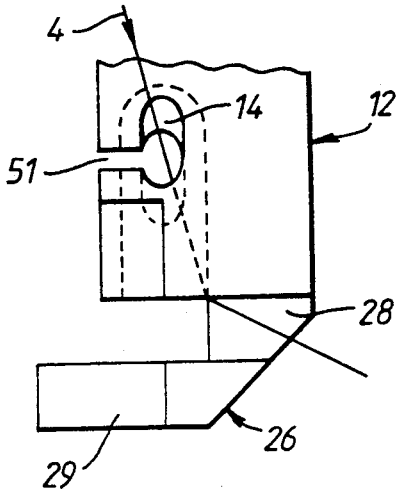

In the embodiment shown in FIGS. 16 and 17, which essentially corresponds to the embodiment shown in FIGS. 2 to 6, the arrangement additionally includes a lateral slot 51 which is open at the edge and which goes into the through opening 14 and which also permits the yarn 4 to be introduced from the side. The mouth opening of the slot 51 is advantageously disposed on the side surface of the yarn guide body, which is in opposite relationship to the side 27.

Figure 18:
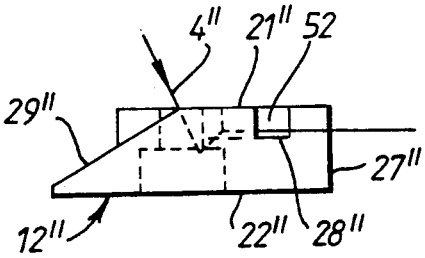
Figure 19:
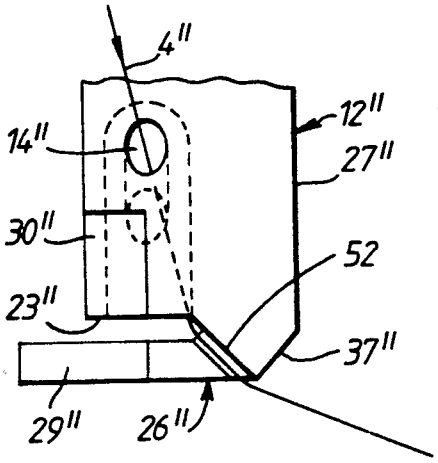

Finally FIGS. 18 and 19 show a yarn guide 12'' in which corresponding components are identified by the same reference characters as in FIGS. 2 to 7, but with a double prime. As in the case of the yarn guide 12, in this embodiment the inclined safety surface 29'' goes into a surface of the extension portion 26'' which terminates flush with the front side 21'' of the yarn guide body. Provided in that surface is a groove or a guide passage 52, the bottom or floor surface of which forms the actual guide surface 28''. The side walls of the guide passage 52 perform substantially the same function as the edges 48 and 49 of the embodiment shown in FIGS. 2 to 6. As FIG. 1 shows, the guide passage 52, in contrast to FIGS. 3 and 4 where it extends perpendicularly to the longitudinal direction of the knitting implements 3, may also be arranged inclinedly with respect to that longitudinal direction. In regard to advantages, function and use options, the yarn guide 12'' corresponds to the yarn guides 12 and 12'.

The invention is not restricted to the described embodiments which may be modified in many ways. For example there is no need for the attachment or extension portion 26, 26', 26'' to be mounted at a lateral end of the yarn guide 12, 12', 12'' as corresponding advantages could be achieved with an extension portion which is arranged in the centre or towards the other side of the yarn guide, if the geometry of the rest of the yarn guide body is correspondingly altered. In addition the various surfaces and edges which come into contact with the yarn 4, 4', 4'' can preferably be rounded off in order to avoid excessively high yarn tensions and/or damage to the yarn. In addition, as shown in broken lines in FIG. 13 in relation to the extension portion 26', the extension portion 26, 26' or 26'' respectively could be produced in that a downwardly open slot opening 53 is formed in the lower part of the yarn guide body, thereby providing a further extension portion 54 arranged on the side of the yarn guide 12' which is remote from the side 27'. Finally it would be possible for the two extension portions 26' and 54 to be connected together by a limb portion in such a way that the slot opening 53 is closed on its underside. The remaining opening would only have to be sufficiently large that the yarn which is to be introduced into the yarn guide can be easily threaded in therethrough or that a tool for engaging a yarn disposed on the rear side can be passed therethrough.

I claim:

1. A yarn feed arrangement which has at least one yarn guide for a circular knitting machine having a needle cylinder, knitting implements which are movably mounted in the needle cylinder and which have hooks for receiving a yarn fed thereto by the yarn guide, and a cam acting on the knitting implements in such a way that the hooks are guided on a track, said track having a raising section, a retraction section and a maximum disposed therebetween, wherein the yarn guide has a front side, a rear side, an underside, an upper side, a side facing the raising section of the track, a side remote from the side facing the raising section, a through opening leading from the front side to the rear side, an extension portion at the underside and a guide surface being provided on a front side of said extension portion, said guide surface being intended to guide the yarn when leaving the yarn guide for feeding the yarn to the hooks from a location outside the track and before and lateral of the maximum in such a way that the yarn is engaged by the hooks being guided along the retraction section, and the arrangement being such that the yarn passes said through opening from the front side to the rear side and is then diverted at the underside and by said extension portion onto said guide surface.

2. A yarn feed arrangement according to claim 1, wherein the extension portion has an inclined surface which inclined surface is to be arranged parallel to and immediately beside the raising section of the track.

3. A yarn feed arrangement according to claim 1, wherein the guide surface is arranged displaced forwardly relative to a rearward exit end of the through opening.

4. A yarn feed arrangement according to claim 2, wherein the guide surface is arranged displaced forwardly relative to a rearward exit end of the through opening.

5. A yarn feed arrangement according to claim 1, wherein the guide surface is arranged between a projection of the through opening onto the underside and the side associated with the raising section.

6. A yarn feed arrangement according to claim 1, wherein the extension portion has an inclined safety surface which inclined surface extends away from the rear side and towards the guide surface.

7. A yarn feed arrangement according to claim 6, wherein the inclined safety surface is provided under the guide surface and on the side of the extension portion which is remote from the side associated with the raising section.

8. A yarn feed arrangement according to claim 1, wherein the guide surface is delimited by edges.

9. A yarn feed arrangement according to claim 1, wherein the guide surface is delimited upwardly by edges.

10. A yarn feed arrangement according to claim 1, wherein the guide surface is delimited downwardly by edges.

11. A yarn feed arrangement according to claim 1, wherein the guide surface is delimited upwardly and downwardly by edges.

12. A yarn feed arrangement according to claim 8, wherein the edges form a guide passage for the yarn.

13. A yarn feed arrangement according to claim 12, wherein the guide passage comprises a forwardly open groove provided in the extension portion.

14. A yarn feed arrangement according to claim 8, wherein an upper edge is disposed under the hooks and a lower edge is disposed above free ends of open latches of respective knitting implements in the position of the maximum.

15. A yarn feed arrangement according to claim 1, wherein the yarn guide, on that side remote from the side associated with the raising section, has an inclined surface which inclined surface extends from the rear forwardly.

16. A yarn feed arrangement according to claim 1, wherein said yarn guide is provided at its rear side with a groove and wherein said through opening opens into said groove.

17. A yarn feed arrangement according to claim 1, wherein a lateral slot with an open edge which open edge is intended for introduction of the yarn opens into the through opening.

18. A yarn feed arrangement according to claim 16, wherein a lateral slot with an open edge which open edge is intended for introduction of the yarn opens into the through opening.

19. A yarn feed arrangement according to claim 1, wherein said through opening declines from the front side rearwardly.

20. A yarn feed arrangement according to claim 16, wherein said through opening declines from the front side rearwardly.

21. A yarn feed arrangement according to claim 1, wherein there is additionally provided a normal yarn guide which has a further through opening for a yarn and which is displaceable between an inoperative position and an operative position in which it is disposed on the front side of the track and immediately in front of the knitting implements.

22. A yarn feed arrangement according to claim 1, wherein there is additionally provided a cover means which is displaceable between an inoperative position and an operative position in which it is disposed on the front side of the track and immediately in front of the knitting implements.

* * * * *